US009765751B2

(12) United States Patent
Tanaya

(10) Patent No.: US 9,765,751 B2
(45) Date of Patent: Sep. 19, 2017

(54) IGNITION APPARATUS

(71) Applicant: MITSUBISHI ELECTRIC CORPORATION, Chiyoda-ku, Tokyo (JP)

(72) Inventor: Kimihiko Tanaya, Chiyoda-ku (JP)

(73) Assignee: Mitsubishi Electric Corporation, Chiyoda-ku, Tokyo (JP)

( * ) Notice: Subject to any disclaimer, the term of this patent is extended or adjusted under 35 U.S.C. 154(b) by 160 days.

(21) Appl. No.: 13/932,455

(22) Filed: Jul. 1, 2013

(65) Prior Publication Data

US 2014/0261346 A1 Sep. 18, 2014

(30) Foreign Application Priority Data

Mar. 18, 2013 (JP) ..... 2013-054629

(51) Int. Cl.
*F02P 9/00* (2006.01)
*F02P 3/02* (2006.01)
(Continued)

(52) U.S. Cl.
CPC ..... *F02P 9/002* (2013.01); *F02P 3/02* (2013.01); *F02P 9/007* (2013.01); *F02P 23/045* (2013.01);
(Continued)

(58) Field of Classification Search
CPC .. F02P 9/002; F02P 15/00; F02P 15/10; F02P 1/08; F02P 1/083; F02P 1/086; F02P 3/0435; F02P 3/051; F02P 3/09
(Continued)

(56) References Cited

U.S. PATENT DOCUMENTS 5,806,504 A * 9/1998 French ..... F02P 9/007 123/605
6,057,652 A * 5/2000 Chen ..... H05B 41/28 315/219
(Continued)

FOREIGN PATENT DOCUMENTS

EP 2 738 381 A2 6/2014
EP 1 961 279 B1 8/2015
(Continued)

OTHER PUBLICATIONS

Japanese Office Action, issued Feb. 12, 2014, Application No. 2013-054629.
(Continued)

*Primary Examiner* — Sizo Vilakazi
*Assistant Examiner* — Kevin R Steckbauer
(74) *Attorney, Agent, or Firm* — Sughrue Mion, PLLC; Richard C. Turner

(57) ABSTRACT

An ignition apparatus includes a spark plug having a high voltage electrode and an external electrode facing each other across a gap and being configured to generate a spark discharge in the gap to ignite a combustible fuel mixture in a combustion chamber of an internal combustion engine, an ignition coil device configured to generate a predetermined high voltage and supply the high voltage to the high voltage electrode to form a path for the spark discharge in the gap, a high frequency power supply having a band-pass filter and being configured to supply an alternating current to the spark discharge path, and a control device configured to control operation timing of the high frequency power supply. The band-pass filter passes a frequency of from 1 MHz to 4 MHz.

6 Claims, 2 Drawing Sheets

(51) Int. Cl.

| | |
|---|---|
| ***F02P 23/04*** | (2006.01) |
| *F02P 3/04* | (2006.01) |
| *F02P 3/05* | (2006.01) |
| *F02P 3/09* | (2006.01) |
| *F02P 15/00* | (2006.01) |

(52) U.S. Cl.
CPC ..... *F02P 3/0435* (2013.01); *F02P 3/051* (2013.01); *F02P 3/09* (2013.01); *F02P 15/00* (2013.01)

(58) Field of Classification Search
USPC ..... 123/620
See application file for complete search history.

(56) References Cited

U.S. PATENT DOCUMENTS

| | | | | |
|---|---|---|---|---|
| 8,226,901 | B2 * | 7/2012 | Makita | F02P 3/01 123/143 B |
| 8,528,531 | B2 * | 9/2013 | Nakano | F02P 9/007 123/596 |
| 8,922,127 | B2 * | 12/2014 | Tanaya | H01T 15/00 315/111.41 |
| 9,035,564 | B1 * | 5/2015 | Itoi | H01T 15/00 315/224 |
| 9,246,313 | B2 * | 1/2016 | Ban | F02P 3/01 |
| 9,263,857 | B2 * | 2/2016 | Nakayama | F02P 1/00 |
| 9,316,199 | B2 * | 4/2016 | Yamada | F02P 15/00 |
| 2009/0309499 | A1 | 12/2009 | Agneray et al. | |
| 2010/0196208 | A1 * | 8/2010 | Makita | F02P 3/01 422/83 |
| 2011/0297131 | A1 * | 12/2011 | Nakano | F02P 9/007 123/596 |
| 2013/0233291 | A1 * | 9/2013 | Yamada | F02P 3/00 123/594 |
| 2013/0234608 | A1 * | 9/2013 | Nakayama | F02P 1/00 315/173 |
| 2014/0145624 | A1 * | 5/2014 | Ban | F02P 3/01 315/172 |
| 2014/0306617 | A1 * | 10/2014 | Tanaya | H01T 15/00 315/223 |
| 2015/0115827 | A1 * | 4/2015 | Itoi | H05H 1/46 315/224 |
| 2016/0138552 | A1 * | 5/2016 | Itoi | F02P 9/002 315/127 |

FOREIGN PATENT DOCUMENTS

| | | | | |
|---|---|---|---|---|
| JP | 2011-072154 | A | 4/2011 | |
| JP | 2011-099410 | A | 5/2011 | |
| JP | 2012-156847 | A | 8/2012 | |
| JP | 2012-220445 | A | 11/2012 | |
| JP | 2012225204 | A * | 11/2012 | F02P 3/01 |
| JP | 2012-251546 | A | 12/2012 | |
| JP | 2012251546 | A * | 12/2012 | F02P 3/01 |
| JP | 2013-005956 | A | 1/2013 | |
| JP | 2014105681 | A * | 6/2014 | F02P 23/04 |

OTHER PUBLICATIONS

Communication dated Jan. 15, 2015 from the Japanese Patent Office in counterpart Application No. 2013-054629.

Communication dated Oct. 18, 2016 from the German Patent and Trademark Office in counterpart Application No. 10 2013 215 663.4.

* cited by examiner

IGNITION APPARATUS

BACKGROUND OF THE INVENTION

Field of the Invention

This invention relates to an ignition apparatus used mainly for operations of an internal combustion engine.

Description of the Related Art

In recent years, the problems of environmental conservation and fuel depletion have been raised. In the automobile industry, it is an urgent task to deal with these problems. An example of the solution is a method of remarkably improving fuel consumption by engine downsizing utilizing a supercharger or by weight reduction.

It has been known that when an internal combustion engine (hereinafter also referred to as an "engine") is in a highly supercharged state, the pressure in the combustion chamber thereof becomes very high even in a state that does not accompany combustion, so it becomes difficult to generate a spark discharge for starting combustion. One of the reasons is that the voltage required for causing dielectric breakdown between the high voltage electrode and the GND electrode (i.e., in the gap) of the spark plug becomes very high and exceeds the withstanding voltage value of the insulator portion of the spark plug.

In order to resolve this problem, research has been conducted to raising the withstanding voltage of the insulator portion. In reality, however, it is currently difficult to ensure sufficient withstanding voltage for meeting the demand, so the circumstance is that there is no other choice than choosing the means to narrow the gap distance of the spark plug. Nevertheless, when the gap of the spark plug is narrowed, another problem arises that the quenching effect of the electrode portion tends to bring about undesirable effects, causing degradation in startability and degradation in combustion performance.

In order to solve this problem, it appears possible to take an avoiding means of imparting an energy that exceeds the quenching effect, that is, the thermal energy taken away by the electrode portion, by way of spark discharge, or causing combustion at a location as far as possible from the electrode. Accordingly, an ignition apparatus disclosed in, for example, Patent Document 1 has conventionally been proposed.

The ignition apparatus disclosed in Patent Document 1 is such that it generates a spark discharge in a spark plug gap with a conventional ignition coil and causes a high frequency current to flow into the path of the spark discharge through a diode and a mixer, whereby it makes possible to form high energy spark discharge and discharge plasma that expands over a wider range than normal spark discharge.

Patent Document 1: JP-A-2011-099410

The conventional ignition apparatus disclosed in Patent Document 1 above contains a diode with a high withstanding voltage. Currently, the high withstanding voltage diode is manufactured with a stack structure using a lead solder, so its size has been made small. However, it has been difficult to adopt such a structure because of the viewpoint of lead-free design in recent years. When the lead-free design is employed, it becomes necessary to ensure a sufficient physical insulation distance. Consequently, problems arise that size reduction becomes difficult and the manufacturing cost becomes very high. On the other hand, it appears possible to pass a high-frequency alternating current of 10 MHz or higher between the electrodes of the spark plug. However, a device that is capable of high-frequency and high current switching and also ensuring reliability is very costly, so this also causes the problem of very high manufacturing cost.

SUMMARY OF THE INVENTION

This invention has been accomplished in order to solve such problems in the conventional apparatus as described above, and it is an object of the invention to provide an ignition apparatus that can obtain the effect that can cancels out the quenching effect and the like with a low-cost and simple structure.

An ignition apparatus according to the invention includes: a spark plug having a first electrode and a second electrode facing each other across a gap and being configured to generate spark discharge in the gap to ignite a combustible fuel mixture in a combustion chamber of an internal combustion engine; a spark discharge path generating device configured to generate a predetermined high voltage and supply the high voltage to the first electrode to form a path for the spark discharge in the gap; a current supplying device having a band-pass filter and being configured to supply an alternating current to the spark discharge path; and a control device configured to control operation timing of the current supplying device, wherein the band-pass filter passes a frequency of from 1 MHz to 4 MHz.

The ignition apparatus according to this invention makes it possible to reduce the amount of fuel used for operating an internal combustion engine remarkably, so it can reduce the amount of $CO_2$ emission significantly and contribute to environmental conservation.

The foregoing and other objects, features, aspects and advantages of the present invention will become more apparent from the following detailed description of the present invention when taken in conjunction with the accompanying drawings.

DETAILED DESCRIPTION OF THE PREFERRED EMBODIMENTS

Hereinbelow, preferred embodiments of the ignition apparatus according to this invention will be described with reference to the drawings. The ignition apparatus according to this invention is an apparatus that generates a spark discharge in the main plug gap of a spark plug by a high voltage produced by an ignition coil device, and in addition, causes a high alternating current to flow into the spark discharge path to thereby form large discharge plasma in the main plug gap.

First Preferred Embodiment

Figure 1:
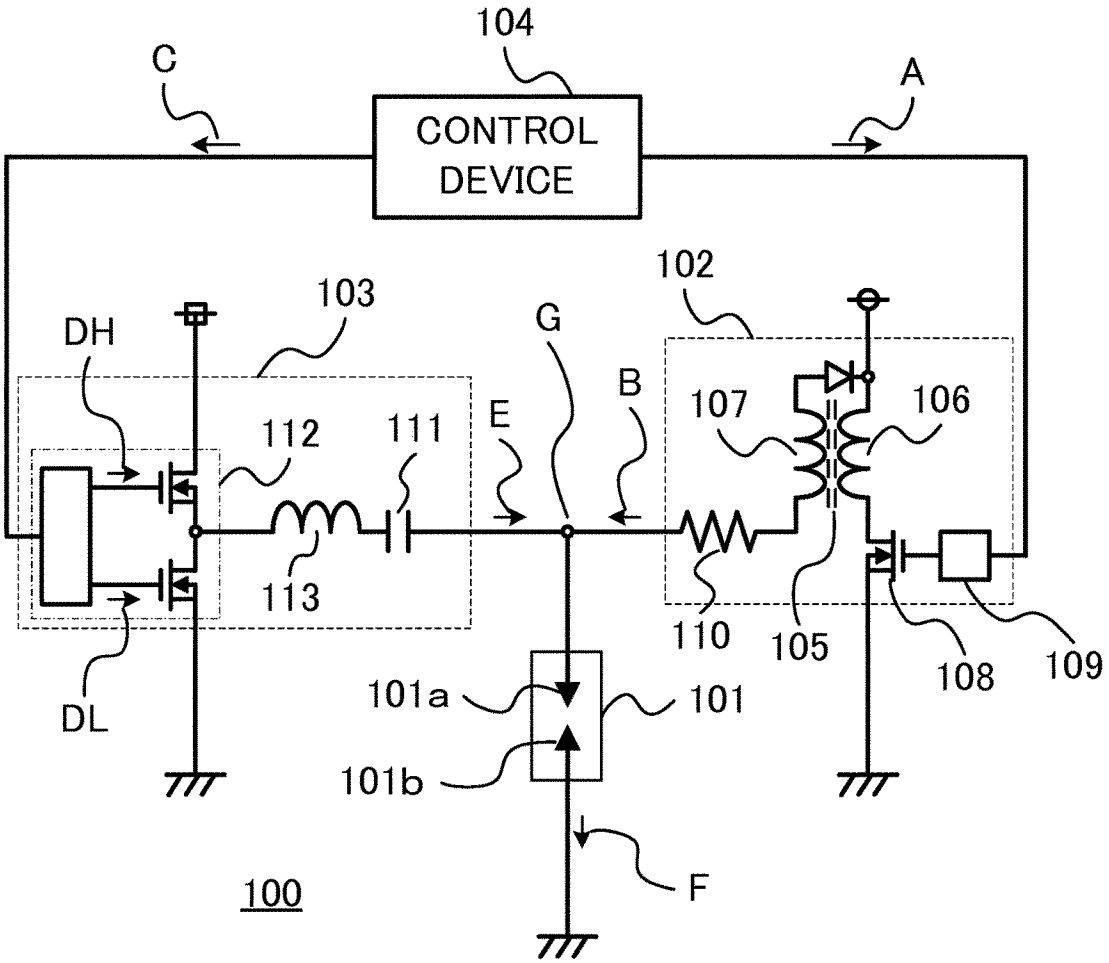
FIG. 1 is a configuration diagram of an ignition apparatus according to a first preferred embodiment of this invention.

FIG. 1 is a configuration diagram of an ignition apparatus according to a first preferred embodiment of this invention. Referring to FIG. 1, an ignition apparatus 100 includes a spark plug 101 that generates a spark discharge to ignite a combustible fuel mixture in a combustion chamber in an internal combustion engine, an ignition coil device 102 serving as a spark discharge path generating device that applies a predetermined high voltage to the spark plug 101 to form a spark discharge path, a high frequency power supply 103 serving as a current supplying device that supplies an alternating current to form large discharge plasma in the spark discharge path, and a control device 104 that controls operation timing of the high frequency power supply 103. The control device 104 also controls the operation of the ignition coil device 102.

The spark plug 101 has a high voltage electrode 101*a* serving as a first electrode, and an external electrode 101*b* serving as a second electrode that faces the high voltage electrode 101*a* across a main plug gap that is a predetermined gap.

The ignition coil device 102 has a primary coil 106 and a secondary coil 107 magnetically coupled to each other via a core 105, a switching element 108 that controls passage of current for the primary coil 106, a driver device 109 that drives the switching element 108, and a resistor device 110 that suppresses the capacitive current system noise that is produced when dielectric breakdown is brought about in the main plug gap of the spark plug 101.

One end of the secondary coil 107 is connected to the high voltage electrode 101*a* of the spark plug 101 via the resistor device 110, and one end of a later-described capacitor 111 is directly connected to the high voltage electrode 101*a* of the spark plug 101. It should be noted that the resistor device 110 is an element for suppressing noise, and depending on the structure of the engine or the condition of the wiring, it is not necessary to provide the resistor device 110 when generation of noise is low. In that case, the one end of the secondary coil 107 is directly connected to the high voltage electrode 101*a* of the spark plug 101, and likewise, the one end of the capacitor 111 is also directly connected to the high voltage electrode 101*a* of the spark plug 101.

The switching element 108 and the driver device 109 may be disposed within the ignition coil device 102 for reducing noise and improving efficiency. Alternatively, the switching element 108 and the driver device 109 may be disposed outside the ignition coil device 102, for example, inside the control device 104 or inside the high frequency power supply 103, for reducing the size and weight of the ignition coil device 102 for the purposes of, for example, reducing the size and lowering the center of gravity of the engine.

The high frequency power supply 103 has a capacitor 111 and an inductor 113. The capacitor 111 and the inductor 113 form a band-pass filter that passes the alternating current supplied to the spark discharge path formed in the main plug gap for forming large discharge plasma but blocks a direct current-like high voltage generated in the secondary coil 107 of the ignition coil device 102 so that it will not be supplied to a switching circuit 112 in the high frequency power supply 103.

The frequency of the band-pass filter is set to be from 1 MHz to 4 MHz. In order to form large discharge plasma efficiently, it is believed necessary that the applied voltage can be switched between positive and negative in the frequency band in which cations can be trapped in the main plug gap. Accordingly, a frequency of 1 MHz or higher is necessary when the gap distance of the main plug gap is about 1 mm.

Also, for a general-purpose switching device that has high reliability and is available in low cost, its operation limit is about 4 MHz. Accordingly, when the frequency of the band-pass filter is set to be from 1 MHz to 4 MHz, large discharge plasma can be generated efficiently using a general-purpose switching device that has high reliability and is available in low cost.

It is desirable that a capacitor having capacitance value of from 40 picofarads to 200 picofarads should be selected for the capacitor 111 of the band-pass filter. This capacitor 111 becomes a target that is charged by the induced current that is an output from the ignition coil device 102. For this reason, when the capacitance value thereof is made too large, the charge cannot reach the dielectric breakdown voltage of the main plug gap because of the induced current, and the spark discharge path may not be formed.

It is believed that the upper limit of the capacitance of the capacitor 111 that enables charging to the dielectric breakdown voltage of the main plug gap in combination with a typical ignition coil device 102 that is currently available in the market is 200 picofarads. When the capacitance value becomes lower, it becomes difficult to pass alternating current therethrough. It is known experimentally that an electric current of 1 ampere or higher at the peak is necessary in order to form large discharge plasma to a degree that can obtain a combustion performance improvement effect. Since the withstanding voltage of general-purpose connector is about 1000 V, it is assumed that the output of the high frequency power supply device 103 is accordingly 1000 V; then, a capacitance of 40 picofarads or higher is required in order to supply a current of 1 ampere at 4 MHz. Therefore, it is desirable that a capacitor having a capacitance value of from 40 picofarads to 200 picofarads should be selected for the capacitor 111. With the just-mentioned capacitance value, relatively small-sized and low cost capacitors are available.

From the frequency of the band-pass filter and the capacitance value of the capacitor 111, the inductance value of the inductor 113 of the band-pass filter is determined to be from about 40 microhenrys to about 120 microhenrys. From the viewpoints of size reduction, cost reduction, and heat generation reduction of the apparatus, it is desirable that the inductance value should be as low as possible. However, in reality, the inductance value is determined from the viewpoint of balance with the above-described capacitor value according to the application used.

With the combinations of the above-mentioned constants, the apparatus can be configured using general-purpose elements, so a low cost and highly efficient apparatus can be realized.

Figure 2:
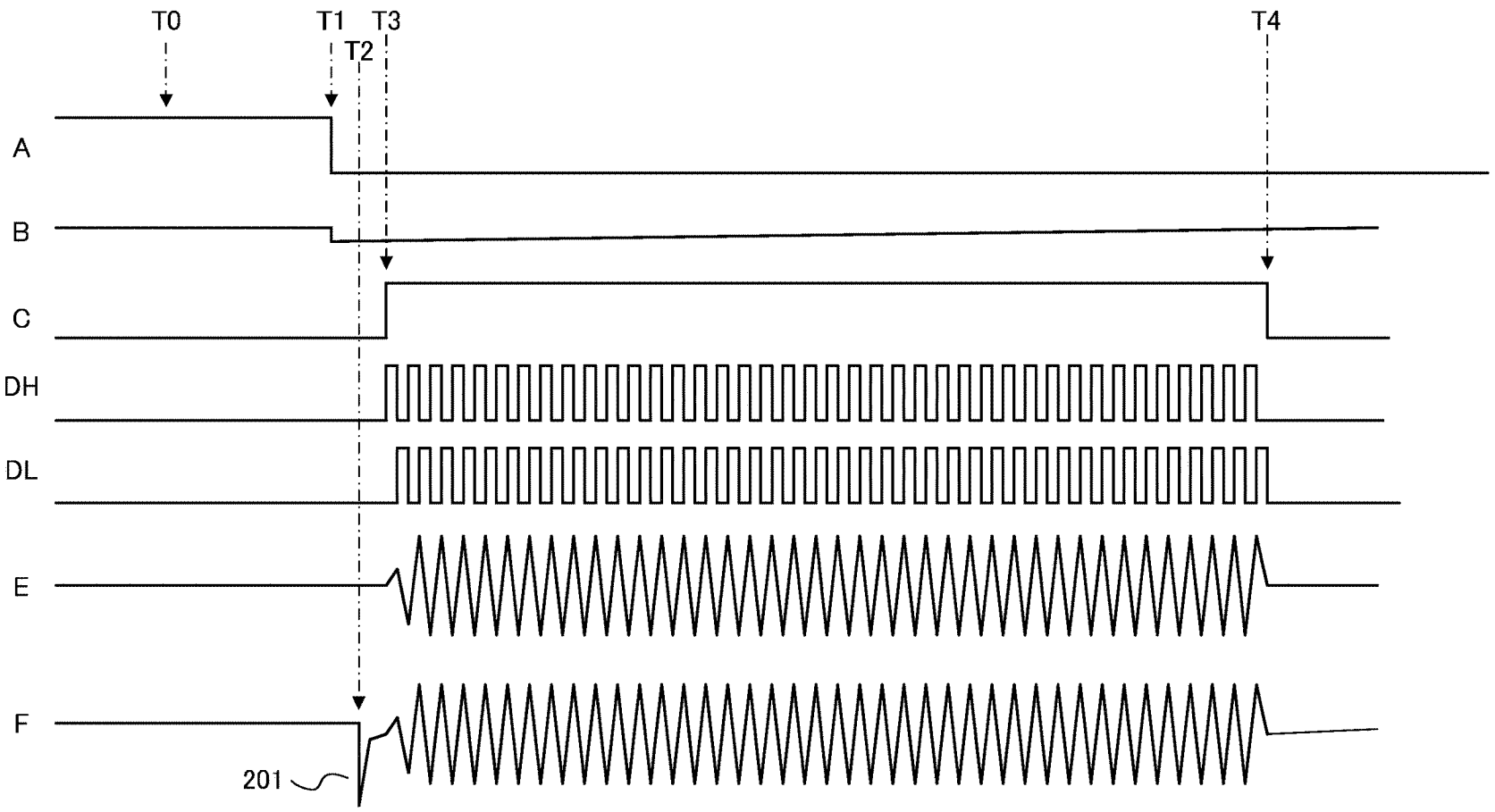
FIG. 2 is a timing chart of the ignition apparatus according to the first preferred embodiment of this invention.

Next, specific operations of the ignition apparatus according to the first preferred embodiment will be described. FIG. 2 is a timing chart showing various signals in the ignition apparatus according to the first preferred embodiment in chronological order.

Signal A in FIG. 2 is a signal in which the direction indicated by the arrow of path A in FIG. 1 is defined as positive, and it is a voltage signal that is output by the control device 104 and is for driving the ignition coil device 102. Signal B in FIG. 2 is a signal in which the direction indicated by the arrow of path B in FIG. 1 is defined as positive, and it is a current signal that represents the output current of the ignition coil device 102. Signal C in FIG. 2 is a signal in which the direction indicated by the arrow of path C in FIG. 1 is defined as positive, and it is a voltage signal that is output by the control device 104 and indicates the period for operating the switching circuit 112 in the high frequency power supply 103.

Signal DH in FIG. 2 is a signal in which the direction indicated by the arrow of path DH in FIG. 1 is defined as positive, and it is a voltage signal for driving the gate of the HIGH-side switching element of the switching circuit 112 that is constructed by a half-bridge in the high frequency power supply 103. Signal DL in FIG. 2 is a signal in which the direction indicated by the arrow of path DL in FIG. 1 is defined as positive, and it is a voltage signal for driving the gate of the LOW-side switching element of the switching circuit 112 that is constructed by a half-bridge in the high frequency power supply 103. Signal E in FIG. 2 is a signal in which the direction indicated by the arrow of path E in FIG. 1 is defined as positive, and it is a current signal that represents the output current of the high frequency power supply 103. Signal F in FIG. 2 is a signal in which the direction indicated by the arrow of path F in FIG. 1 is defined as positive, and it is a current signal that represents the discharge current passing through the spark discharge path formed in the main plug gap between the high voltage electrode 101*a* and the external electrode 101*b* of the spark plug 101.

At time T0 in FIG. 2, signal A is already turned HIGH, so the switching element 112 in the ignition coil device 102 is in an ON state, and the primary coil 106 is in an electrically energized state. At this point, magnetic flux energy is being stored in the core 105.

At time T1, when signal A is turned LOW, the current passing the primary coil 106 is blocked by the switching element 108 in the ignition coil device 102. Then, the magnetic flux energy that has been stored in the core 105 is released, and an induced voltage is generated in the secondary coil 107. Accordingly, the induced current shown as B in FIG. 2 starts to flow into path B, and at the same time, the ground capacitor that the spark plug 101 potentially has, and the capacitor 111 in the high frequency power supply 103 start to be charged.

At time T2, when the charge voltage to the ground capacitor of the spark plug 101 and the capacitor 111 reaches the dielectric breakdown voltage between the high voltage electrode 101*a* and the external electrode 101*b* of the spark plug 101 (i.e., in the main plug gap), dielectric breakdown occurs in the main plug gap, and a spark discharge path is formed. At the same time, the current caused by the discharge of the electric charge stored in the capacitors, that is, a capacitive current 201, flows into the spark discharge path.

While the capacitive current 201 is flowing, the potential of point G in FIG. 1 is still high, so it is difficult to stably supply electric current from the high frequency power supply 103 to the discharge path in the main plug gap. Therefore, the control device 104 turns signal C to HIGH at time T3 so that an alternating current is allowed to pass approximately from the time when the capacitive current subsides, permitting the operation of the switching circuit 112.

It is desirable that the interval from time T1 to time T3 should be set to a mapped value or calculated value that is determined according to the operation condition. The reason is that when the conditions such as engine revolution number, load, and temperature change, the dielectric breakdown voltage of the main plug gap also changes, and time T2 accordingly changes. For example, when in an idle state at about 700 revolution per minute, the interval from time T1 to time T3 is set to 50 microseconds, and when in a full throttle load state at about 4000 revolution per minute, the interval from time T1 to time T3 is set to 100 microseconds. Also, when the engine coolant temperature exceeds 80° C., an interval of 10 microseconds is subtracted therefrom indiscriminately.

When the switching circuit 112 is permitted to operate by signal C, the switching circuit 112 starts a switching operation such as to feed alternating current toward the spark discharge path formed in the main plug gap. In the first preferred embodiment, the switching circuit 112 is configured to be a half bridge, and a band-pass filter constructed by the inductor 113 and the capacitor 111 is disposed in the later stage. Thus, according to the frequency of this band-pass filter, signal DH and signal DL are repeatedly switched over as shown in FIG. 2 so that the HIGH-side switch and the LOW-side switch of the half bridge are alternately turned ON and OFF. During this time, the output current of the high frequency power supply 103 is as shown by signal E in FIG. 2.

As a result, the current represented by signal F flows through the spark discharge path formed in the main plug gap. The current represented by signal F is the sum of signal B, which is the output current of the ignition coil device 102 (from about 50 mA to about 300 mA), and signal E, which is the output current of the high frequency power supply 103 (from about 2 A to about 10 A).

The control device 104 turns signal C to LOW at time T4 to stop the operation of the switching circuit 112. The operation of the switching circuit 112 stops, and the supply of large alternating current to the spark discharge path in the main plug gap stops.

It is desirable that the interval from time T3 to time T4 and the level of the input alternating current should be mapped values and calculated values that are set depending on the operating conditions and the discharge conditions. For example, when the engine coolant temperature is less than 80° C. and the engine revolution number is 1000 revolution per minute or less, a 5-A peak alternating current discharge is input for a 500-microsecond period, then at the time point when the engine revolution number exceeds 3000 revolution per minute, a 5-A peak alternating current discharge is input for a 300-microsecond period, and when the engine revolution number exceeds 4000 revolution per minute, a 3-A peak alternating current discharge is input for a 300-microsecond period. When the engine coolant temperature exceeds 80° C., an interval of 100 microseconds is subtracted from the interval from time T3 to time T4 indiscriminately.

As has been discussed above, the ignition apparatus according to the first preferred embodiment makes it possible to form large discharge plasma efficiently with a low cost and simple configuration, and does not impair the startability or combustion performance even when using a spark plug with a narrow gap. Therefore, it becomes possible to carry out, for example, weight reduction by high supercharging downsizing and thermal efficiency improvement by increasing compression ratio. As a result, it becomes possible to reduce the amount of fuel used for operating an internal combustion engine remarkably, and to reduce the amount of $CO_2$ emission significantly, making it possible to contribute to environmental conservation.

Hereinabove, an ignition apparatus according to the first preferred embodiment has been described. However, it should be understood that various modifications and alterations of this invention are possible within the scope of the invention. The ignition apparatus according to this invention may be incorporated in automobiles, motorcycles, outboard engines, and other special machines that uses internal combustion engines, so that ignition of fuel can be done reliably. As a result, ignition apparatus according to this invention allows the internal combustion engine to be operated efficiently, and can serve a role in solving the fissile fuel depletion problem and in environmental conservation.

Various modifications and alterations of this invention will be apparent to those skilled in the art without departing from the scope and spirit of this invention, and it should be understood that this invention is not limited to the illustrative embodiments set forth herein.

What is claimed is:

1. An ignition apparatus comprising:

a spark plug having a first electrode and a second electrode facing each other across a gap and being configured to generate a spark discharge in the gap to ignite a combustible fuel mixture in a combustion chamber of an internal combustion engine;

a spark discharge path generating device configured to generate a predetermined high voltage and supply the high voltage to the first electrode to form a path for the spark discharge in the gap;

a current supplying device configured to supply an alternating current to the spark discharge path; and a control circuit configured to control operation timing of the current supplying device, wherein:

the current supplying device has a band-pass filter including an inductor and a capacitor and being configured to pass a frequency of from 1 MHz to 4 MHz, and a switching circuit comprising a first switch and a second switch being connected between the control circuit and the band-pass filter, and being configured to operate by an output from the control circuit;

the control circuit is configured to calculate a time when a capacitive current subsides based on engine speed, load, or coolant temperature, and to operate the current supplying device to supply the alternating current to the spark discharge path in response to the calculated time being surpassed, the capacitive current flowing into the spark discharge path from a ground capacitance of the spark plug and the capacitor as a result of a charge voltage of an induced current that is generated by the spark discharge path generating device and supplied to the ground capacitance of the spark plug and the capacitor reaching a dielectric breakdown voltage of the gap; and the first switch and the second switch of the switching circuit are repeatedly switched over so as to be alternately turned ON and OFF according to a frequency of the band-pass filter.

2. The ignition apparatus as set forth in claim 1, wherein the inductor and the capacitor are connected in series along a path supplying the alternating current to the spark plug, and wherein the inductor has an inductance value of from 40 microhenrys to 120 microhenrys.

3. The ignition apparatus as set forth in claim 1, wherein the inductor and the capacitor are connected in series along a path supplying the alternating current to the spark plug, and wherein the capacitor has a capacitance value of from 40 picofarads to 200 picofarads.

4. The ignition apparatus as set forth in claim 1, wherein the inductor and the capacitor are connected in series along a path supplying the alternating current to the spark plug, and wherein the inductor has an inductance value of from 40 microhenrys to 120 microhenrys, and the capacitor has a capacitance value of from 40 picofarads to 200 picofarads.

5. The ignition apparatus as set forth in claim 1, wherein the inductor and the capacitor are connected in series.

6. The ignition apparatus as set forth in claim 1, wherein the inductor and the capacitor are connected in series along a path supplying the alternating current to the spark plug.

* * * * *